United States Patent [19]

Mori et al.

[11] Patent Number: 5,041,194

[45] Date of Patent: Aug. 20, 1991

[54] ALUMINUM ELECTROPLATING METHOD

[75] Inventors: Shoichiro Mori; Kazuhiko Ida; Hitoshi Suzuki, all of Ami; Seteuko Takahashi; Isao Saeki, both of Ichikawa, all of Japan

[73] Assignees: Mitsubishi Petrochemical Co., Ltd.; Nisshin Steel Co., Ltd., both of Tokyo, Japan

[21] Appl. No.: 523,361

[22] Filed: May 15, 1990

[30] Foreign Application Priority Data

| | | | |
|---|---|---|---|
| May 18, 1989 | [JP] | Japan | 1-122740 |
| May 18, 1989 | [JP] | Japan | 1-122741 |
| Jun. 22, 1989 | [JP] | Japan | 1-158289 |
| Jul. 28, 1989 | [JP] | Japan | 1-193862 |
| Oct. 18, 1989 | [JP] | Japan | 1-269032 |
| Oct. 18, 1989 | [JP] | Japan | 1-269033 |

[51] Int. Cl.[5] ..... C25D 3/44

[52] U.S. Cl. ..... 204/58.5

[58] Field of Search ..... 204/58.5, 39

[56] References Cited

U.S. PATENT DOCUMENTS

| | | | |
|---|---|---|---|
| 2,446,331 | 8/1948 | Hurley | 204/39 |
| 2,446,350 | 8/1948 | Wier | 204/39 |
| 4,071,415 | 1/1978 | Wong | 204/58.5 |
| 4,747,916 | 5/1988 | Kato et al. | 204/58.5 |
| 4,904,355 | 2/1990 | Takahashi et al. | 204/58.5 |

*Primary Examiner*—John F. Niebling

*Assistant Examiner*—Kishor Mayekar

*Attorney, Agent, or Firm*—Oblon, Spivak, McClelland, Maier & Neustadt

[57] ABSTRACT

There is disclosed an aluminum electroplating method, which compriss using a low melting composition comprising a mixture of 20 to 80 mole % of an aluminum halide and 80 to 20 mole % of an onium halide of a nitrogen-containing compound selected from the group consisting of bicyclic quaternary amidinium halides, 1-alkylaminopyridinium halides, trialkylimidazolium halides, benzimidazolium halides, alicyclic quaternary ammonium halides and asymmetric tetraalkylammonium halides.

11 Claims, No Drawings

ALUMINUM ELECTROPLATING METHOD

BACKGROUND OF THE INVENTION

This invention relates to a method for plating electrochemically aluminum efficiently by use of a composition containing aluminum.

Electroplating of aluminum can be done with difficulty in a plating bath of an aqueous solution system, because affinity of aluminum for oxygen is great, with the potential being baser than hydrogen. For this reason, electroplating of aluminum has been investigated in non-aqueous solution systems, particularly in a plating bath of an organic solvent system.

As such organic solvent system plating bath, a solution of aluminum chloride and $LiAlH_4$ or LiH dissolved in ether or a solution of aluminum chloride and $LiAlH_4$ dissolved in tetrahydrofuran is a representative example (e.g. D. E. Couch et al, J. Electrochem., Vol. 99 (6), p. 234). However, since all of these plating baths contain very active $LiAlH_4$ or LiH therein, if oxygen or moisture exists, the reaction with those occurred to effect decomposition, whereby current efficiency was lowered, or the life of the bath became shortened. Also, the boiling point of an organic solvent is low, thus having a problem that the risk of explosion or combustion is high.

Further, as another example, there has been also proposed a plating bath of triethyl aluminum and NaF dissolved in toluene (R. Suchentrunk, Z. Werkstofftech, vol. 12, p. 190). However, also in this case, handling of triethyl aluminum with high danger poses a very great problem, and practical application thereof may be considered to be difficult.

As described above, although the prior arts may be somewhat successful in the technical task of plating aluminum, they can be hardly said to be widely applicable in general as practical technique because of difficulty in handling of the chemical substances employed.

SUMMARY OF THE INVENTION

In view of such points, the present invention proposes a novel electric aluminum plating bath easy in handling and capable of efficiently plating of aluminum, a plating method by use of the bath. Thus, according to the proposal of the present invention, plating of aluminum is possible at high current efficiency and high current density, and with good productivity.

Further, in the electric aluminum plating bath and the plating method by use of the bath of the present invention, by use of aluminum for the electrode, Al ions consumed by plating can be automatically supplemented by Al dissolution from the anode, and therefore bath management can be easy, and is also more excellent in workability in this respect than other methods.

The present inventors have made investigations intensively about aluminum electroplating bath and plating method by use of the bath, and consequently found that a composition formed by mixing an aluminum halide with at least one of a bicyclic quaternary amidinium, a 1-alkylaminopyridinium halide, a trialkylimidazolium halide, a benzimidazolium halide, an alicyclic quaternary ammonium halide or an asymmetric tetraalkylammonium halide as an onium halide of a nitrogen-containing compound has excellent characteristics as the aluminum electroplating bath.

One characteristic feature of the composition according to the present invention resides in forming a low melting compound in wide composition range of two compounds, which becomes a liquid easily handled over a wide range also at normal temperature. The second characteristic feature is that these compositions have considerably high ion conductivity under molten state.

Thus, these characteristic features are excellent important basic characteristics, and the present composition can be said to have very excellent characteristics as aluminum electroplating bath.

DESCRIPTION OF THE PREFERRED EMBODIMENTS

The bicyclic quaternary amidinium halide as the onium halide of a nitrogen-containing compound as herein described is a compound represented by the following formula:

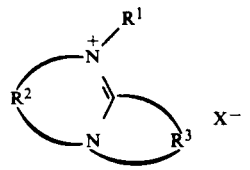

(I)

wherein $R^1$ is an alkyl group having 1 to 12 carbon atoms, $R^2$, $R^3$ each represent an alkylene group having 1 to 6 carbon atoms, the alkyl group or alkylene group mentioned here referring to straight hydrocarbon groups, branched hydrocarbon groups and further those containing aromatic hydrocarbon groups in a part thereof and X represents a halogen atom.

1-Alkylaminopyridinium halide is a compound represented by the formula:

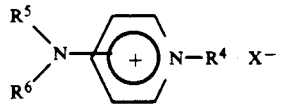

(II)

wherein $R^4$ is an alkyl group having 1 to 12 carbon atoms, $R^5$ hydrogen atom or an alkyl group having 1 to 6 carbon atoms and $R^6$ an alkyl group having 1 to 6 carbon atoms, the alkyl group mentioned here referring to straight hydrocarbon groups, branched hydrocarbon groups and further those containing aromatic hydrocarbon groups in a part thereof and X has the same meaning as defined above.

Trialkylimidazolium halide is a 1,2,3-trialkylimidazolium halide compound represented by the formula:

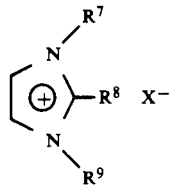

(III)

wherein $R^7$, $R^8$ and $R^9$ each represent an alkyl group having 1 to 6 carbon atoms, the alkyl group mentioned here referring to straight hydrocarbon groups, branched hydrocarbon groups and further those containing aromatic hydrocarbon groups in a part thereof and X has the same meaning as defined above.

Alkylbenzimidazolium halide is a 1,3-dialkylbenzimidazolium halide compound represented by the formula:

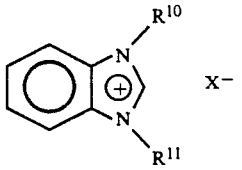

(IV)

wherein $R^{10}$ and $R^{11}$ each represent an alkyl group having 1 to 6 carbon atoms and X has the same meaning as defined above.

Alicyclic quaternary ammonium halide is a compound represented by the formula:

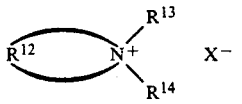

(V)

wherein $R^{12}$ represents an alkylene group having 1 to 6 carbon atoms, $R^{13}$ and $R^{14}$ each represent an alkyl group having 1 to 6 carbon atoms and X has the same meaning as defined above.

Asymmetric tetraalkylammonium halide is a compound represented by the formula:

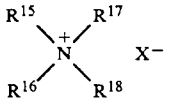

(VI)

wherein $R^{15}$, $R^{16}$, $R^{17}$ and $R^{18}$ are each an alkyl group having 1 to 12 carbon atoms, provided that at least one is different from other alkyl groups and X has the same meaning as defined above.

Specific examples of the bicyclic quaternary amidinium halide (I) may include 5-methyl-1-aza-5-azoniabicyclo-4,3,0]5-nonene bromide, 5-ethyl-1-aza-5-azoniabicyclo-4,3,0]5-nonene chloride, 8-methyl-1-aza-8-azoniabicyclo-5,4,0]7-undecene iodide, 8-ethyl-1-aza-8-azoniabicyclo-5,4,0]7-undecene chloride and the like.

Specific examples of the 1-alkylaminopyridinium halide (II) may include 1-methyl-4-dimethylaminopyridinium iodide, 1-ethyl-4-dimethylaminopyridinium bromide, 1-ethyl-4-dimethylaminopyridinium chloride, 1-ethyl-4-(N-ethyl-N-methyl)aminopyridinium chloride, 1-ethyl-4-aminopyridinium iodide, 1-n-butyl-4-dimethylaminopyridinium fluoride, 1-benzyl-4-dimethylaminopyridinium chloride, 1-n-octyl-4-dimethylaminopyridinium chloride, 1-ethyl-4-piperidinopyridinium bromide, 1-ethyl-4-pyrrolidinopyridinium chloride, 1-ethyl-4-pyrrolidinopyridinium bromide and the like.

Specific examples of the 1,2,3-trialkylimidazolium halide (III) may include 1,2,3-trimethylimidazolium bromide, 1,2,3-trimethylimidazolium iodide, 1,2-dimethyl-3-ethylimidazolium bromide, 1,2-dimethyl-3-ethylimidazolium chloride, 1,2-dimethyl-3-butylimidazolium fluoride and the like.

Specific examples of the 1,3-dialkylbenzimidazolium halide (IV) may include 1,3-dimethylbenzimidazolium bromide, 1,3-dimethylbenzimidazolium iodide, 1-methyl-3-ethylbenzimidazolium bromide, 1-methyl-3-ethylbenzimidazolium chloride, 1-methyl-3-butylbenzimidazolium fluoride, 1-ethyl-3-propyl-benzimidazolium bromide and the like.

Specific examples of the alicyclic quaternary ammonium halide (V) may include N,N-dimethylpyrrolidinium bromide, N-ethyl-N-methylpyrrolidinium chloride, N,N-dimethylpiperidinium bromide, N-ethyl-N-methylpiperidinium chloride, N,N-diethylpiperidinium bromide and the like.

Specific examples of the tetraalkylammonium halide (VI) may include methyltriethylammonium chloride, diethyldimethylamonium bromide, ethyltrimethylammonium bromide, hexyltrimethylammonium bromide, butyltripropylammonium chloride and the like.

As the aluminum halide, $AlX_3$ (X=halogen), specifically $AlF_3$, $AlCl_3$, $AlBr_3$ and $AlI_3$ can be included.

The plating bath of the composition having a low melting point and containing aluminum according to the present invention is prepared by mixing and melting an aluminum halide and an onium halide of a nitrogen-containing compound. In this case, a composition having a low melting point can be made by mixing 20 to 80 mole % of an aluminum halide and 80 to 20 mole % of an onium halide of a nitrogen-containing compound, preferably 50 to 70 mole % of an aluminum halide and 30 to 50 mole % of an onium halide of a nitrogen-containing compound. For example, in the composition of aluminum chloride and 5-ethyl-1-aza-5-azoniabicyclo[4,3,0]5-nonene chloride, a composition which is liquid at room temperature and has considerably low viscosity can be obtained in the entire region of aluminum chloride concentration of 55 to 80 mole %.

In the composition of aluminum chloride and 1-ethyl-4-dimethylaminopyridinium bromide, it is liquid at 50° C. in the entire region of aluminum chloride concentration of 20 to 80 mole %, in the composition of aluminum chloride and 1,2-dimethyl-3-ethylimidazolium bromide, it is liquid at 50° C. in the entire region of aluminum chloride concentration of 55 to 80 mole %, in the composition of aluminum chloride and 1-methyl-3-ethylbenzimidazolium bromide, it is liquid at normal temperature in the entire region of aluminum concentration of 55 to 80 mole %, in the composition of aluminum chloride and methyl-triethylammonium chloride, it is liquid at normal temperature in the entire region of aluminum chloride concentration of 60 to 75 mole %, and in the composition of aluminum chloride and N-ethyl-N-methylpiperidinium bromide, it is liquid at normal temperature in the entire region of aluminum chloride concentration of 60 to 75 mole %, and compositions each with considerably low concentration can be obtained.

In the case of practicing efficiently aluminum electroplating by use of the above-mentioned aluminum electroplating bath, a preferable range as the plating bath may comprise 50 to 75 mole % of an aluminum halide and 25 to 50 mole % of an onium halide of a nitrogen-containing compound, more preferably 55 to 70 mole % of an aluminum halide and 30 to 45 mole % of an onium halide of a nitrogen-containing compound and most preferably 60 to 67 mole % of an aluminum halide and 33 to 40 mole % of an onium halide. In a system where the aluminum halide is too small, the reaction which may be considered to be the decomposition of the onium cation occurs, while in a system where the aluminum halide is too much, the viscosity of the bath tends to be elevated undesirably.

The novel composition can be generally prepared according to the process comprising the two steps as described below.

As the first step, an alkyl halide and a nitrogen-containing compound together with a reaction solvent are charged into a reactor made of a glass, and the reaction is carried out at 20° to 200° C., preferably 50° to 120° C. After the reaction, the solvent and the unreacted materials are removed to obtain an onium halide of the nitrogen-containing compound. In this case, as the reaction solvent, hydrocarbons such as benzene, toluene, hexane, etc., water, polar solvents such as methanol, ethanol, tetrahydrofuran, dimethylformamide, dimethyl sulfoxide, etc. can be used.

In the second step, the onium halide of the nitrogen-containing compound prepared in the first step and the aluminum halide are heated and mixed under the state suspended in an appropriate solvent under an inert gas atmosphere, followed by removal of the solvent, whereby a desired aluminum electroplating bath can be prepared. In this case, since considerable heat generation is accompanied during mixing, it is necessary to take care so that the temperature will not be raised uncontrollably. As the reaction solvent in this case, aromatic hydrocarbons such as benzene, toluene, chlorobenzene, etc. can be used.

Aluminum electroplating is generally practiced under dry oxygen-free atmosphere from such points as maintenance of stability of the plating bath and plating properties. Plating can be effected at good current efficiency and uniformly under the plating conditions of a bath temperature of 0° to 300° C., preferably 20° to 100° C. with direct current or pulse current and a current density of 0.01 to 50 A/dm$^2$, preferably 1 to 20 A/dm$^2$. If the bath temperature is too low, no uniform plating can be effected, while if the bath temperature is too high or the current density is too high, decomposition of onium cations, nonunifomization of plated layer, and further lowering in current efficiency will occur undesirably.

In the case of plating a strip uniformly and continuously, the Al ion concentration is required to be maintained at a level within a certain range by supplementing Al ions, but in this case, when the anode is made a soluble electrode made of aluminum, Al ions can be supplemented automatically corresponding to the current passage amount, whereby the Al ion concentration can be maintained within a certain range without supplementing aluminum halide.

In the case of effecting plating at a low temperature, it is effective to add an organic solvent into the plating bath. In this case, as the organic solvent, inert solvents such as benzene, toluene, xylene, chlorobenzene, etc. are preferred, and they may be used in an amount generally of 5 to 100 % by volume added.

Also, for increasing the conductivity of the plating bath or effecting uniformization of the aluminum plated layer, it is effective to add a halide of an alkali metal or an alkaline earth metal. In this case, as examples of alkali metal or alkaline earth metal halides, LiCl, NaCl, NaF, $CaCl_2$, etc. can be included, and these compounds may be used in an amount of 0.1 to 30 mole % added in the plating bath.

EXAMPLES

The present invention will be explained in more detail below by referring to Examples by which the present invention is not limited.

Example 1

Into an autoclave made of stainless steel were charged 1.0 mole (96.1 g) of 1,2-dimethylimidazole, 1.1 mole (119.9 g) of ethyl bromide and 50 g of methanol as the solvent, and the reaction was carried out under stirring at 90° C. for 5 hours. From the reaction product were removed the solvent and unreacted materials by use of a rotary evaporator to give 201.5 g of a solid. The solid was 1,2-dimethyl-3-ethylimidazolium bromide, and the yield of the reaction based on 1,2-dimethylimidazole was 98 mole %.

Next, 20.5 g (0.10 mole) of the resulting 1,2-dimethyl-3-ethylimidazolium bromide was placed in a reactor made of a glass in nitrogen atmosphere, and 26.6 g (0.20 mole) of aluminum chloride was gradually mixed. By throwing of aluminum chloride and heating to 80° C., the reaction occurred at the solid interface with 1,2-dimethyl-3-ethylimidazolium bromide, whereby liquefaction progressed gradually. However, since the reaction was accompanied with heat generation, the total amount of aluminum chloride was thrown carefully so that the reaction temperature did not exceed 90° C. The mixture was liquid at normal temperature, and exhibited a conductivity of 6.5 mS/cm at 25° C. Also, in this system, the relationship between temperature and conductivity when the molar ratio of aluminum chloride to 1,2-dimethyl-3-ethylimidazolium bromide is varied from 1.2 to 2 has become as shown in Table 1. Since the system is under solution state at 50° C. within the range of all molar ratios, and also exhibits high conductivity, it is excellent as electric aluminum plating bath.

TABLE 1

Relationship between molar ratio and conductivity

| | Molar ratio | | |
|---|---|---|---|
| Temperature | 1.2 | 1.5 | 2.0 |
| 25 (°C.) | | | 6.5 |
| 30 | | | 7.6 |
| 40 | | 10.2 | 10.0 |
| 50 | 13.5 | 13.4 | 13.2 |
| 60 | 17.6 | 17.0 | 16.6 |

Examples 2, 3, 4 and 5

According to the same reaction method as in Example 1, 1,2-dimethyl-3-ethylimidazolium chloride was prepared from 1,2-dimethylimidazole and ethyl chloride (Example 2), 1,2-dimethyl-3-butylimidazolium chloride from 1,2-dimethylimidazole and butyl chloride (Example 3), and 1,2,3-trimethylimidazolium bromide from 1,2-dimethylimidazole and methyl bromide (Example 4).

These quaternary salts were mixed with aluminum chloride according to the same method as in Example 1 to prepare compositions with a molar ratio of aluminum chloride to quaternary salt of 2.0. The results of measurement of conductivities of these compositions are shown in Table 2.

Further, a composition of aluminum bromide and 1,2-dimethyl-3-ethylimidazolium chloride prepared in Example 2 with a molar ratio of aluminum chloride to quaternary salt of 2.0 was prepared (Example 5), and the result of measurement of conductivity is shown in Table 2.

TABLE 2

| Conductivities of various compositions | | |
|---|---|---|
| Example | Temperature (°C.) | Conductivity (mS/cm) |
| 2 | 25 | 6.8 |
| | 50 | 12.6 |
| 3 | 25 | 4.8 |
| | 50 | 10.2 |
| 4 | 25 | 4.6 |
| | 50 | 10.1 |
| 5 | 50 | 9.3 |

Example 6

A cold rolled steel plate with a plate thickness of 0.5 mm applied with solvent vapor washing, alkali defatting and acid washing in conventional manners was dried, and immediately thereafter dipped in the compositions shown in the foregoing Examples previously maintained in nitrogen atmosphere as the electric aluminum plating bath.

Then, with the cold rolled plate as the cathode, and an aluminum plate (purity 99.99 %, plate thickness 1.0 mm) as the anode, aluminum plating was effected with direct current.

When plating was performed by use of the composition of aluminum chloride and 1,2-dimethyl-3-ethylimidazolium bromide with a molar ratio of 2.0 of Example 1 as the plating bath under the electrolytic conditions of a bath temperature of 25° C., a current density of 1 A/dm$^2$, electrolysis time of 30 minutes, a dense aluminum plating with a thickness of plated layer of 6 microns was obtained at a current efficiency of 95 % or higher.

Example 7

By use of a plating bath of the composition of aluminum chloride and 1,2-dimethyl-3-ethylimidazolium chloride with a molar ratio of 2.0 of Example 2, aluminum plating was effected on the cold rolled steel plate according to the same method as in Example 6.

When plating was performed under the electrolytic conditions of a bath temperature of 50° C., a current density of 4 A/dm$^2$ and an electrolysis time of 10 minutes, a dense aluminum plating with a thickness of 8 microns of the plated layer was obtained at a current efficiency of 95 % or higher.

Example 8

A plating bath comprising the composition of aluminum chloride and 1,2-dimethyl-3-ethylimidazolium chloride with a molar ratio of 2.0 of Example 2 and toluene as organic solvent mixed at 1 : 1 (volume ratio) was prepared. The plating bath exhibited a conductivity of 16.3 mS/cm at 25° C., and exhibited a value higher by 2-fold or more as compared with one not mixed with toluene.

By use of the plating bath, aluminum plating was effected according to the same method as in Example 6.

When plating was performed under the electrolytic conditions of a bath temperature of 25° C., a current density of 1 A/dm$^2$ and an electrolysis time of 30 minutes, a dense and glossy aluminum plating with a thickness of 6 microns of the plated layer was obtained at a current efficiency of 95% or higher.

Example 9

By use of a plating bath of the composition of aluminum chloride and 1,2-dimethyl-3-butylimidazolium chloride with a molar ratio of 2.0 of Example 3, aluminum plating was effected on a steel plate (plate thickness 0.5 mm) according to the same method as in Example 6.

When plating was performed under the electrolytic conditions of a bath temperature of 50° C., a current density of 4 A/dm$^2$ and an electrolysis time of 10 minutes, a dense aluminum plating with a thickness of 8 microns of the plated layer was obtained at a current efficiency of 95 % or higher.

Example 10

Into an autoclave made of stainless steel were charged 1.0 mole (122.2 g) of 4-dimethylaminopyridine, 1.1 mole (119.9 g) of ethyl bromide and 120 g of ethanol as the solvent, and the reaction was carried out under stirring at 110° C. for 9 hours. From the reaction product were removed the solvent and unreacted materials by use of a rotary evaporator to give 229.1 g of a solid. The solid was 1-ethyl-4-dimethylaminopyridinium bromide, and the yield of the reaction based on 4-dimethylaminopyridine was 99 mole %.

Next, 23.1 g (0.10 mole) of 1-ethyl-4-dimethylaminopyridinium bromide was placed in a reactor made of a glass in nitrogen atmosphere, and 13.3 g (0.10 mole) of aluminum chloride was gradually mixed. By throwing of aluminum chloride, the reaction occurred at the solid interface with 1-ethyl-4-dimethylaminopyridinium bromide, whereby liquefaction progressed gradually. However, since the reaction was accompanied with heat generation, the total amount of aluminum chloride was thrown carefully so that the reaction temperature did not exceed 70° C. The mixture was liquid at normal temperature, and exhibited a conductivity of 8.1 mS/cm at 25° C. Also, in this system, the relationship between temperature and conductivity when the molar ratio of aluminum chloride to 1-ethyl-4-dimethylaminopyridinium bromide is varied from 0.8 to 2 has become as shown in Table 3. Since the system is under solution state at normal temperature within the range of all molar ratios, and also exhibits high conductivity, it is excellent as electric aluminum plating bath.

TABLE 3

| Relationship between molar ratio and conductivity | | | | |
|---|---|---|---|---|
| | Molar ratio | | | |
| Temperature | 0.8 | 1.0 | 1.5 | 2.0 |
| 25 (°C.) | 4.1 | 8.1 | 6.2 | 5.4 |
| 30 | 4.8 | 9.6 | 7.4 | 6.5 |
| 40 | 6.3 | 13.2 | 10.0 | 8.8 |
| 50 | 9.4 | 17.2 | 13.2 | 11.6 |
| 60 | 12.7 | 21.4 | 16.8 | 14.5 |

EXAMPLES 11, 12 AND 13

According to the same reaction method as in Example 10, 1-ethyl-4-dimethylaminopyridinium chloride was prepared from 4-dimethylaminopyridine and ethyl chloride (Example 11), 1-ethyl-4-(1-pyrrolidinyl)-pyridinium chloride from 4-(1-pyrrolidinyl)pyridine and ethyl chloride (Example 12).

These quaternary salts were mixed with aluminum chloride according to the same method as in Example 10 to prepare compositions with molar ratios of aluminum chloride to quaternary salt of 1.0 and 2.0. The results of measurement of conductivities of these compositions are shown in Table 4.

Further, a composition of aluminum bromide and 1-ethyl-4-dimethylaminopyridinium chloride prepared in Example 11 with molar ratios of 1.0 and 2.0 was prepared (Example 13), and the results of measurement of conductivities are shown in Table 4.

TABLE 4

Conductivities of various compositions

| Example | Molar ratio | Temperature (°C.) | Conductivity (mS/cm) |
|---|---|---|---|
| 11 | 1.0 | 25 | 9.8 |
| | | 50 | 10.5 |
| | 2.0 | 25 | 6.4 |
| | | 50 | 13.1 |
| 12 | 1.0 | 25 | 4.7 |
| | | 50 | 10.1 |
| | 2.0 | 25 | 3.1 |
| | | 50 | 7.2 |
| 13 | 1.0 | 50 | 14.7 |
| | 2.0 | 50 | 10.2 |

EXAMPLE 14

A cold rolled steel plate with a plate thickness of 0.5 mm applied with solvent vapor washing, alkali defatting and acid washing in conventional manners was dried, and immediately thereafter dipped in the compositions shown in the foregoing Examples previously maintained in nitrogen atmosphere as the electric aluminum plating bath.

Then, with the cold rolled plate as the cathode, and an aluminum plate (purity 99.99 %, plate thickness 1.0 mm) as the anode, aluminum plating was effected with direct current.

When plating was performed by use of the composition of aluminum chloride and 1-ethyl-4-dimethylaminopyridinium bromide with a molar ratio of 2.0 of Example 10 as the plating bath under the electrolytic conditions of a bath temperature of 25° C., a current density of 1 A/dm$^2$, electrolysis time of 30 minutes, a dense aluminum plating with a thickness of plated layer of 6 microns was obtained at a current efficiency of 95 % or higher.

Example 15

By use of a plating bath of the composition of aluminum chloride and 1-ethyl-4-dimethylaminopyridinium chloride with a molar ratio of 2.0 of Example 11, aluminum plating was effected on the cold rolled steel plate according to the same method as in Example 14.

When plating was performed under the electrolytic conditions of a bath temperature of 50° C., a current density of 10 A/dm$^2$ and an electrolysis time of 10 minutes, a dense aluminum plating with a thickness of 20 microns of the plated layer was obtained at a current efficiency of 95 % or higher.

Example 16

A plating bath comprising the composition of aluminum chloride and 1-ethyl-4-dimethylaminopyridinium chloride with a molar ratio of 2.0 of Example 11 and toluene as organic solvent mixed at 1 : 1 (volume ratio) was prepared. The plating bath exhibited a conductivity of 12.6 mS/cm at 25° C., and exhibited a value higher by 2-fold or more as compared with one not mixed with toluene.

By use of the plating bath, aluminum plating was effected according to the same method as in Example 15.

When plating was performed under the electrolytic conditions of a bath temperature of 25° C., a current density of 1 A/dm$^2$ and an electrolysis time of 30 minutes, a dense and glossy aluminum plating with a thickness of 6 microns of the plated layer was obtained at a current efficiency of 95% or higher.

Example 17

By use of a plating bath of the composition of aluminum chloride and 1-ethyl-4-(1-pyrrolidinyl)pyridinium chloride with a molar ratio of 2.0 of Example 12, aluminum plating was effected on a steel plate (plate thickness 0.5 mm) according to the same method as in Example 14.

When plating was performed under the electrolytic conditions of a bath temperature of 50° C., a current density of 10 A/dm$^2$ and an electrolysis time of 10 minutes, a dense aluminum plating with a thickness of 20 microns of the plated layer was obtained at a current efficiency of 95 % or higher.

Example 18

Into an autoclave made of stainless steel were charged 1.0 mole (124.2 g) of 1,5-diazabicyclo[4,3,0]5-nonene, 1.1 mole (71.0 g) of ethyl chloride and 100 g of isopropanol as the solvent, and the reaction was carried out under stirring at 110° C. for 5 hours. From the reaction product were removed the solvent and unreacted materials by use of a rotary evaporator to give 186.8 g of a solid. The solid was 5-ethyl-1-aza-5-azoniabicyclo[4,3,0]5-nonene chloride, and the yield of the reaction based on 1,5-diazabicyclo-[4,3,0]5-nonene was 99 mole %.

Next, 18.9 g (0.10 mole) of 5-ethyl-1-aza-5-azoniabicyclo- [4,3,0]5-nonene chloride obtained was placed in a reactor made of a glass in nitrogen atmosphere, and 26.6 g (0.20 mole) of aluminum chloride was gradually mixed. By throwing of aluminum chloride and heating to 80° C., the reaction occurred at the solid interface with 5-ethyl-1-aza-5-azoniabicyclo[4,3,0]5 -nonene chloride, whereby liquefaction progressed gradually. However, since the reaction was accompanied with heat generation, the total amount of aluminum chloride was thrown carefully so that the reaction temperature did not exceed 90° C. The mixture was liquid at normal temperature, and exhibited a conductivity of 2.9 mS/cm at 25° C. Also, in this system, the relationship between temperature and conductivity when the molar ratio of aluminum chloride to 5-ethyl-1-aza-5-azoniabicyclo[4,3,0]5-nonene chloride is varied from 1.2 to 2 has become as shown in Table 5. Since the system is under solution state at room temperature within the range of all molar ratios, and also exhibits high conductivity, it is excellent as electric aluminum plating bath.

TABLE 5

Relationship between molar ratio and conductivity

| Temperature | Molar ratio 1.2 | 1.5 | 2.0 |
|---|---|---|---|
| 25 (°C.) | 2.7 | 2.8 | 2.9 |
| 30 | 3.6 | 3.5 | 3.5 |
| 40 | 5.0 | 4.8 | 4.7 |
| 50 | 8.6 | 6.8 | 5.8 |

TABLE 5-continued

| Relationship between molar ratio and conductivity | | | |
|---|---|---|---|
| | Molar ratio | | |
| Temperature | 1.2 | 1.5 | 2.0 |
| 60 | 11.6 | 8.9 | 6.7 |

Examples 19, 20, 21 and 22

According to the same reaction method as in Example 18, 5-methyl-1-aza-5-azoniabicyclo[4,3,0]5-nonene bromide was prepared from 1,5-diazabicyclo[4,3,0]5-nonene and methyl bromide (Example 19), 8-methyl-1-aza-8-azoniabicyclo-[5,4,0]7-undecene iodide from 1,8-diazabicyclo[5,4,0]7undecene and methyl iodide (Example 20) and 8-ethyl-1-aza-8-azoniabicyclo[5,4,0]7-undecene chloride from 1,8-diazabicyclo[5,4,0]7-undecene and ethyl chloride (Example 21).

These quaternary salts were mixed with aluminum chloride according to the same method as in Example 18 to prepare compositions with a molar ratio of aluminum chloride to quaternary salt of 2.0. The results of measurement of conductivities of these compositions are shown in Table 6.

Further, a composition of aluminum bromide and 5-ethyl-1-aza-5-azoniabicyclo[4,3,0]5-nonene chloride prepared in Example 18 with a molar ratio of 2.0 was prepared (Example 22), and the result of measurement of conductivity is shown in Table 6.

TABLE 6

| Conductivities of various compositions | | |
|---|---|---|
| Example | Temperature (°C.) | Conductivity (mS/cm) |
| 19 | 25 | 2.4 |
| | 50 | 4.6 |
| 20 | 25 | 1.1 |
| | 50 | 2.7 |
| 21 | 25 | 1.2 |
| | 50 | 3.4 |
| 22 | 50 | 4.3 |

Example 23

A cold rolled steel plate with a plate thickness of 0.5 mm applied with solvent vapor washing, alkali defatting and acid washing in conventional manners was dried, and immediately thereafter dipped in the compositions shown in the foregoing Examples previously maintained in nitrogen atmosphere as the electric aluminum plating bath.

Then, with the cold rolled plate as the cathode, and an aluminum plate (purity 99.99 %, plate thickness 1.0 mm) as the anode, aluminum plating was effected with direct current.

When plating was performed by use of the composition of aluminum chloride and 5-ethyl-1-aza-5-azoniabicyclo-4,3,0]5-nonene chloride with a molar ratio of 2.0 of Example 18 as the plating bath under the electrolytic conditions of a bath temperature of 25° C., a current density of 1 A/dm$^2$, electrolysis time of 30 minutes, a dense aluminum plating with a thickness of plated layer of 6 microns was obtained at a current efficiency of 95 % or higher.

Example 24

By use of a plating bath of the composition of aluminum chloride and 8-ethyl-1-aza-8-azoniabicyclo[5,4,0]7-undecene chloride with a molar ratio of 2.0 of Example 21, aluminum plating was effected on the cold rolled steel plate according to the same method as in Example 23.

When plating was performed under the electrolytic conditions of a bath temperature of 50° C., a current density of 4 A/dm$^2$ and an electrolysis time of 10 minutes, a dense aluminum plating with a thickness of 8 microns of the plated layer was obtained at a current efficiency of 95 % or higher.

Example 25

A plating bath comprising the composition of aluminum chloride and 8-ethyl-1-aza-8-azoniabicyclo[5,4,0]7-undecene chloride with a molar ratio of 2.0 of Example 21 and toluene as organic solvent mixed at 1 : 1 (volume ratio) was prepared. The plating bath exhibited a conductivity of 9.3 mS/cm at 25° C., and exhibited a value higher by 9-fold or more as compared with one not mixed with toluene.

By use of the plating bath, aluminum plating was effected according to the same method as in Example 23.

When plating was performed under the electrolytic conditions of a bath temperature of 25° C., a current density of 1 A/dm$^2$ and an electrolysis time of 30 minutes, a dense and glossy aluminum plating with a thickness of 6 microns of the plated layer was obtained at a current efficiency of 95% or higher.

Example 26

Into an autoclave made of stainless steel were charged 1.0 mole (132.2 g) of 1-methylbenzimidazole, 1.1 mole (119.9 g) of ethyl bromide and 100 g of methanol as the solvent, and the reaction was carried out under stirring at 90° C. for 5 hours. From the reaction product were removed the solvent and unreacted materials by use of a rotary evaporator to give 236.7 g of a solid. The solid was 1-methyl-3-ethylbenzimidazolium bromide, and the yield of the reaction based on 1-methylbenzimidazole was 98 mole %.

Next, 24.1 g (0.10 mole) of 1-methyl-3-ethylbenzimidazolium bromide were placed in a reactor made of a glass in nitrogen atmosphere, and 26.6 g (0.20 mole) of aluminum chloride was gradually mixed. By throwing of aluminum chloride, the reaction occurred at the solid interface with 1-methyl-3-ethylbenzimidazolium bromide, whereby liquefaction progressed gradually. However, since the reaction was accompanied with heat generation, the total amount of aluminum chloride was thrown carefully so that the reaction temperature did not exceed 80° C. The mixture was liquid at normal temperature, and exhibited a conductivity of 2.6 mS/cm at 25° C. Also, in this system, the relationship between temperature and conductivity when the molar ratio of aluminum chloride to 1-methyl-3-ethylbenzimidazolium bromide is varied from 1 to 2 has become as shown in Table 7. Since the system is under solution state at normal temperature within the range of all molar ratios, and also exhibits high conductivity, it is excellent as an electric aluminum plating bath.

TABLE 7

| Relationship between molar ratio and conductivity | | | |
|---|---|---|---|
| | Molar ratio | | |
| Temperature | 1.0 | 1.5 | 2.0 |
| 25 (°C.) | 1.0 | 1.7 | 2.6 |
| 30 | 1.4 | 2.0 | 3.1 |

TABLE 7-continued

| Relationship between molar ratio and conductivity | | | |
|---|---|---|---|
| | Molar ratio | | |
| Temperature | 1.0 | 1.5 | 2.0 |
| 40 | 2.6 | 3.6 | 4.6 |
| 50 | 4.3 | 5.5 | 6.4 |
| 60 | 6.1 | 7.5 | 8.5 |

Examples 27, 28 and 29

According to the same reaction method as in Example 26, 1-methyl-3-ethylbenzmidazolium chloride was synthesized from 1-methylbenzimidazole and ethyl chloride (Example 27), and 1-isopropyl-3-ethylbenzimidazolium bromide from 1-isopropylbenzimidazole and ethyl bromide (Example 28).

These quaternary salts were mixed with aluminum chloride according to the same method as in Example 26 to prepare compositions with a molar ratio of aluminum chloride to quaternary salt of 2.0. The results of measurement of conductivities of these compositions are shown in Table 8.

Further, a composition of aluminum bromide and 1-methyl-3-ethylbenzmidazolium chloride prepared in Example 26 with a molar ratio of 2.0 was prepared (Example 29), and the result of measurement of conductivity is shown in Table 8.

TABLE 8

| Conductivities of various compositions | | |
|---|---|---|
| Example | Temperature (°C.) | Conductivity (mS/cm) |
| 27 | 25 | 2.7 |
| | 50 | 6.6 |
| 28 | 25 | 1.2 |
| | 50 | 3.4 |
| 29 | 50 | 4.7 |

Example 30

A cold rolled steel plate with a plate thickness of 0.5 mm applied with solvent vapor washing, alkali defatting and acid washing in conventional manners was dried, and immediately thereafter dipped in the compositions shown in the foregoing Examples previously maintained in nitrogen atmosphere as the electric aluminum plating bath.

Then, with the cold rolled plate as the cathode, and an aluminum plate (purity 99.99 %, plate thickness 1.0 mm) as the anode, aluminum plating was effected with direct current.

When plating was performed by use of the composition of aluminum chloride and 1-methyl-3-ethylbenzimidazolium bromide with a molar ratio of 2.0 of Example 26 as the plating bath under the electrolytic conditions of a bath temperature of 25° C., a current density of 1 A/dm$^2$, electrolysis time of 30 minutes, a dense aluminum plating with a thickness of plated layer of 6 microns was obtained at a current efficiency of 95 % or higher.

Example 31

By use of a plating bath of the composition of aluminum chloride and 1-methyl-3-ethylbenzimidazolium chloride with a molar ratio of 2.0 of Example 27, aluminum plating was effected on the cold rolled steel plate according to the same method as in Example 30.

When plating was performed under the electrolytic conditions of a bath temperature of 50° C., a current density of A/dm$^2$ and an electrolysis time of 10 minutes, a dense aluminum plating with a thickness of 8 microns of the plated layer was obtained at a current efficiency of 95 % or higher.

Example 32

A plating bath comprising the composition of aluminum chloride and 1-isopropyl-3-ethylbenzimidazolium bromide with a molar ratio of 2.0 of Example 28 and toluene as organic solvent mixed at 1 : 1 (volume ratio) was prepared. The plating bath exhibited a conductivity of 8.1 mS/cm at 25° C., and exhibited a value higher by 6-fold or more as compared with one not mixed with toluene.

By use of the plating bath, aluminum plating was effected according to the same method as in Example 30.

When plating was performed under the electrolytic conditions of a bath temperature of 25° C., a current density of 1 A/dm$^2$ and an electrolysis time of 30 minutes, a dense and glossy aluminum plating with a thickness of 6 microns of the plated layer was obtained at a current efficiency of 95% or higher.

Example 33

Into an autoclave made of a glass were charged 1.0 mole (87.2 g) of diethylmethylamine, 1.1 mole (71.0 g) of ethyl chloride and 80 g of methanol as the solvent, and the reaction was carried out under stirring at 100° C. for 7 hours. From the reaction product were removed the solvent and unreacted materials by use of a rotary evaporator to give 150.2 g of a solid. The solid was methyltriethylammonium chloride, and the yield of the reaction based on diethylmethylamine was 99 mole %.

Next, 15.2 g (0.10 mole) of methyltriethylammonium chloride was placed in a reactor made of a glass in nitrogen atmosphere, and 26.6 g (0.20 mole) of aluminum chloride was gradually mixed. By throwing of aluminum chloride, the reaction occurred at the solid interface with methyltriethylammonium chloride, whereby liquefaction progressed gradually. However, since the reaction was accompanied with heat generation, the total amount of aluminum chloride was thrown carefully so that the reaction temperature did not exceed 70° C. The mixture was liquid at normal temperature, and exhibited a conductivity of 2.1 mS/cm at 25° C. Also, in this system, since the relationship between temperature and conductivity becomes as shown in Table 9. exhibiting high conductivity, it is excellent as electric aluminum plating bath.

TABLE 9

| Relationship between molar ratio and conductivity | |
|---|---|
| Temperature (°C.) | |
| 25 | 2.1 |
| 30 | 2.6 |
| 40 | 3.6 |
| 50 | 5.1 |
| 60 | 6.0 |

Examples 34, 35 and 36

According to the same reaction method as in Example 33, diethyldimethylammonium bromide was prepared from dimethylethylamine and ethyl bromide (Example 34), hexyltrimethylammonium bromide from trimethylamine and hexyl bromide (Example 35), and butyltripropylammonium bromide from tripropylamine and butyl bromide (Example 36).

These quaternary salts were mixed with aluminum chloride according to the same method as in Example 33 to prepare compositions with a molar ratio of aluminum chloride to quaternary salt of 2.0. The results of measurement of conductivities of these compositions are shown in Table 10.

TABLE 10

| Conductivities of various compositions | | |
|---|---|---|
| Example | Temperature (°C.) | Conductivity (mS/cm) |
| 34 | 25 | 0.5 |
| | 50 | 1.8 |
| 35 | 25 | 1.7 |
| | 50 | 4.3 |
| 36 | 50 | 2.3 |

Example 37

A cold rolled steel plate with a plate thickness of 0.5 mm applied with solvent vapor washing, alkali defatting and acid washing in conventional manners was dried, and immediately thereafter dipped in the compositions shown in the foregoing Examples previously maintained in nitrogen atmosphere as the electric aluminum plating bath.

Then, with the cold rolled plate as the cathode, and an aluminum plate (purity 99.99 %, plate thickness 1.0 mm) as the anode, aluminum plating was effected with direct current.

When plating was performed by use of the composition of aluminum chloride and methyltriethylammonium chloride with a molar ratio of 2.0 of Example 33 as the plating bath under the electrolytic conditions of a bath temperature of 25° C., a current density of 1 A/dm$^2$, electrolysis time of 30 minutes, a dense aluminum plating with a thickness of plated layer of 6 microns was obtained at a current efficiency of 95% or higher.

Example 38

By use of a plating bath of the composition of aluminum chloride and diethyldimethylammonium bromide with a molar ratio of 2.0 of Example 34, aluminum plating was effected on the cold rolled steel plate according to the same method as in Example 37.

When plating was performed under the electrolytic conditions of a bath temperature of 50° C., a current density of 4 A/dm$^2$ and an electrolysis time of 10 minutes, a dense aluminum plating with a thickness of 8 microns of the plated layer was obtained at a current efficiency of 95% or higher.

Example 39

By use of a plating bath of the composition of aluminum chloride and butyltrioropylammonium bromide with a molar ratio of 2.0 of Example 35, aluminum plating was effected according to the same method as in Example 37.

When plating was performed under the electrolytic conditions of a bath temperature of 25° C., a current density of 1 A/dm$^2$ and an electrolysis time of 30 minutes, a dense aluminum plating with a thickness of 6 microns of the plated layer was obtained at a current efficiency of 95% or higher.

Example 40

A plating bath comprising the composition of aluminum chloride and butyltripropylammonium bromide with a molar ratio of 2.0 of Example 36 and toluene as organic solvent mixed at 1 : 1 (volume ratio) was prepared. The plating bath exhibited a conductivity of 4.1 mS/cm at 25° C.

By use of the plating bath, aluminum plating was effected on a steel plate (plate thickness 0.5 mm) according to the same method as in Example 37.

When plating was performed under the electrolytic conditions of a bath temperature of 25° C., a current density of 1 A/dm$^2$ and an electrolysis time of 30 minutes, a dense and glossy aluminum plating with a thickness of 6 microns of the plated layer was obtained at a current efficiency of 95% or higher.

Example 41

Into an autoclave made of a glass were charged 1.0 mole (88.2 g) of N-methylpiperidine, 1.1 mole (119.9 g) of ethyl bromide and 50 g of methanol as the solvent, and the reaction was carried out under stirring at 50° C. for 5 hours. From the reaction product were removed the solvent and unreacted materials by use of a rotary evaporator to give 204.0 g of a solid. The solid was N-ethyl-N-methylpiperidinium bromide, and the yield of the reaction based on N-methylpiperidine was 98 mole %.

Next, 20.8 g (0.10 mole) of N-ethyl-N-methylpiperidinium bromide and 12.5 g of toluene were placed in a reactor made of a glass in nitrogen atmosphere, and 26.6 g (0.20 mole) of aluminum chloride was gradually mixed. By throwing of aluminum chloride, the reaction occurred at the solid interface with N-ethyl-N-methylpiperidinium bromide, whereby liquefaction progresses gradually. However, since the reaction was accompanied with heat generation, the total amount of aluminum chloride was thrown carefully so that the reaction temperature did not exceed 70° C. After sufficient progress of the reaction, toluene was evaporated. The mixture was liquid at normal temperature, and exhibited a conductivity of 1.6 mS/cm at 25° C. Also, in this system, since the relationship between temperature and conductivity in the presence and after evaporation of toluene has become as shown in Table 11, and also high conductivity is exhibited, it is excellent as electric aluminum plating bath.

TABLE 11

| Relationship between molar ratio and conductivity | | |
|---|---|---|
| Temperature | Toluene | After evaporation |
| 25 (°C.) | 6.8 | 1.6 |
| 30 | 8.0 | 2.0 |
| 40 | 10.0 | 2.8 |
| 50 | — | 4.0 |
| 60 | — | 5.2 |

Examples 42, 43 and 44

According to the same reaction method as in Example 41, N,N-dimethylpyrrolidinium bromide was synthesized from N-methylpyrrolidine and methyl bromide (Example 42), N,N-diethylpiperidinium bromide from N-ethylpiperidine and ethyl bromide (Example 43), and N-ethyl-N-methylpyrrolidinium bromide from N-methylpyrrolidine and ethyl bromide (Example 44).

These quaternary salts were mixed with aluminum chloride according to the same method as in Example 41 to prepare compositions with a molar ratio of aluminum chloride to quaternary salt of 2.0. The results of measurement of conductivities of these compositions are shown in Table 12.

TABLE 12

Conductivities of various compositions

| Example | Temperature (°C.) | Conductivity (mS/cm) Toluene | After evaporation |
|---|---|---|---|
| 42 | 25 | 7.4 | 2.1 |
| | 50 | 14.6 | 5.1 |
| 35 | 25 | 10.2 | 2.3 |
| | 50 | 17.2 | 5.4 |
| 36 | 50 | 10.0 | 3.4 |

Example 45

A cold rolled steel plate with a plate thickness of 0.5 mm applied with solvent vapor washing, alkali defatting and acid washing in conventional manners was dried, and immediately thereafter dipped in the compositions shown in the foregoing Examples previously maintained in nitrogen atmosphere as the electric aluminum plating bath.

Then, with the cold rolled plate as the cathode, and an aluminum plate (purity 99.99 %, plate thickness 1.0 mm) as the anode, aluminum plating was effected with direct current.

When plating was performed by use of the composition of aluminum chloride and N-ethyl-N-methylpiperidinium bromide with a molar ratio of 2.0 of Example 41 as the plating bath under the electrolytic conditions of a bath temperature of 25° C., a current density of 1 A/dm$^2$, electrolysis time of 30 minutes, a dense aluminum plating with a thickness of plated layer of 6 microns was obtained at a current efficiency of 95 % or higher.

Example 46

By use of a plating bath of the composition of aluminum chloride and N,N-dimethylpyrrolidinium bromide with a molar ratio of 2.0 of Example 42, aluminum plating was effected on the cold rolled steel plate according to the same method as in Example 45.

When plating was performed under the electrolytic conditions of a bath temperature of 50° C., a current density of 4 A/dm$^2$ and an electrolysis time of 10 minutes, a dense aluminum plating with a thickness of 8 microns of the plated layer was obtained at a current efficiency of 95 % or higher.

Example 47

By use of a plating bath before evaporation of toluene comprising the composition of aluminum chloride and N,N-diethylpiperidinium bromide with a molar ratio of 2.0 of Example 43, aluminum plating was effected according to the method as described in Example 45.

When plating was performed under the electrolytic conditions of a bath temperature of 25° C., a current density of 1 A/dm$^2$ and an electrolysis time of 30 minutes, a dense and glossy aluminum plating with a thickness of 6 microns of the plated layer was obtained at a current efficiency of 95% or higher.

Example 48

By use of a plating bath of the composition of aluminum chloride and N-ethyl-N-methylpyrrolidinium bromide with a molar ratio of 2.0 of Example 44, aluminum plating was effected on a steel plate (plate thickness 0.5 mm) according to the same method as in Example 45.

When plating was performed under the electrolytic conditions of a bath temperature of 25° C., a current density of 1 A/dm$^2$ and an electrolysis time of 30 minutes, a dense aluminum plating with a thickness of 6 microns of the plated layer was obtained at a current efficiency of 95 % or higher.

According to the present invention, aluminum plating is possible at high current efficiency and with high current density and good productivity.

Further, in the electric aluminum plating bath and the plating method with that bath of the present invention, when aluminum is used for the anode, Al ions consumed by plating is automatically supplemented by Al dissolution from the anode, and therefore bath management is simple, and workability is more excellent also in this respect than other methods.

The specific features of the novel composition according to the present invention are that it forms a low melting compound to become a liquid which can be handled easily even at normal temperature, and also that the novel composition has a considerably high ion conductivity under molten state, and further that the alicyclic quaternary ammonium cation, etc. is electrochemically stable.

Thus, these specific features are important specific features as the plating bath, and according to the composition of the present invention, aluminum plating is possible at high current efficiency and high current density, and also with good productivity.

Further, in the aluminum electroplating method by use of the composition of the present invention, by use of aluminum for the anode, Al ions consumed by plating can be supplemented by Al dissolution from the anode, whereby the bath management can be simple to give more excellent workability in this respect than other methods.

What is claimed is:

1. An aluminum electroplating method, which comprises using a low melting composition comprising a mixture of 20 to 80 mole % of an aluminum halide and 80 to 20 mole % of an onium halide of a nitrogen-containing compound selected from the group consisting of those shown below as the plating bath:

(i) bicyclic quaternary amidinium halides of the formula:

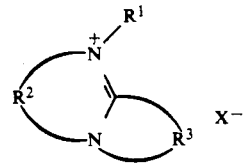

(I)

wherein $R^1$ is an alkyl group having 1 to 12 carbon atoms, $R^2$, $R^3$ each represent an alkylene group having 1 to 6 carbon atoms, the alkyl group or alkylene group mentioned here referring to straight hydrocarbon groups, branched hydrocarbon groups and further those containing aromatic hydrocarbon groups in a part thereof and X represents a halogen atom, (ii) 1-alkylaminopyridinium halides of the formula:

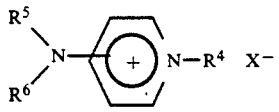

(II)

wherein $R^4$ is an alkyl group having 1 to 12 carbon atoms, $R^5$ hydrogen atom or an alkyl group having 1 to 6 carbon atoms and $R^6$ an alkyl group having 1 to 6 carbon atoms, the alkyl group mentioned here referring to straight hydrocarbon groups, branched hydrocarbon groups and further those containing aromatic hydrocarbon groups in a part thereof and X has the same meaning as defined above, (iii) trialkylimidazolium halides of the formula:

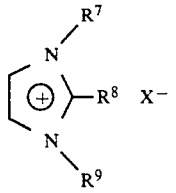

(III)

wherein $R^7$, $R^8$ and $R^9$ each represent an alkyl group having 1 to 6 carbon atoms, the alkyl group mentioned here referring to straight hydrocarbon groups, branched hydrocarbon groups and further those containing aromatic hydrocarbon groups in a part thereof and X has the same meaning as defined above, (iv) benzimidazolium halides of the formula:

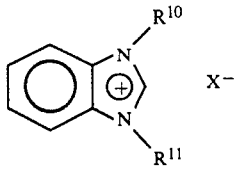

(IV)

wherein $R^{10}$ and $R^{11}$ each represent an alkyl group having 1 to 6 carbon atoms and X has the same meaning as defined above, (v) alicyclic quaternary ammonium halides of the formula:

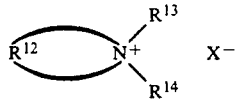

(V)

wherein $R^{12}$ represents an alkylene group having 1 to 6 carbon atoms, $R^{13}$ and $R^{14}$ each represent an alkyl group having 1 to 6 carbon atoms and X has the same meaning as defined above, and (vi) asymmetric tetraalkylammoium halides of the formula:

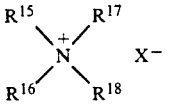

(VI)

wherein $R^{15}$, $R^{16}$, $R^{17}$ and $R^{18}$ are each an alkyl group having 1 to 12 carbon atoms, provided that at least one is different from other alkyl groups and X has the same meaning as defined above.

2. An aluminum electroplating method according to claim 1, wherein a plating bath containing 0.1 to 30 mole % of an alkali metal and/or alkaline earth metal halide added in the bath of claim 1 is used.

3. An aluminum electroplating method according to claim 1, wherein an electric plating method containing an organic solvent added in the plating bath of claim 1 is used.

4. An aluminum electroplating method, which comprises effecting plating with a direct current or pulse current in a bath temperature of 0° to 300° C., a current density of 0.01 to 50 $A/dm^2$ by use of the plating bath of claim 1.

5. An aluminum electroplating method, which comprises effecting plating by use of the plating bath of claim 1, with the anode being made of aluminum.

6. An aluminum electroplating method according to claim 1, wherein the bicyclic quaternary amidinium halide (I) is a compound selected from the group consisting of 5-methyl-1-aza-5-azoniabicyclo-[4,3,0]5-nonene bromide, 5-ethyl-1-aza-5-azoniabicyclo-[4,3,0]5-nonene chloride, 8-methyl-1-aza-8-azoniabicyclo-[5,4,0]7-undecene iodide and 8-ethyl-1-aza-8-azoniabicyclo-[5,4,0]7-undecene chloride.

7. An aluminum electroplating method according to claim 1, wherein the 1-alkylaminopyridinium halide (II) is a compound selected from the group consisting of 1-methyl-4-dimethylaminopyridinium iodide, 1-ethyl-4-dimethylaminopyridinium bromide, 1-ethyl-4-dimethylaminopyridinium chloride, 1-ethyl-4-(N-ethyl-N-methyl)aminopyridinium chloride, 1-ethyl-4-aminopyridinium iodide, 1-n-butyl-4-dimethylaminopyridinium fluoride, 1-benzyl-4-dimethylaminopyridinium chloride, 1-n-octyl-4-dimethylaminopyridinium chloride, 1-ethyl-4-piperidinopyridinium bromide, 1-ethyl-4-pyrrolidinopyridinium chloride and 1-ethyl-4-pyrrolidinopyridinium bromide.

8. An aluminum electroplating method according to claim 1, wherein the 1,2,3-trialkylimidazolium halide (III) is a compound selected from the group consisting of 1,2,3-trimethylimidazolium bromide, 1,2,3-trimethylimidazolium iodide, 1,2-dimethyl-3-ethylimidazolium bromide, 1,2-dimethyl-3-ethylimidazolium chloride and 1,2-dimethyl-3-butylimidazolium fluoride.

9. An aluminum electroplating method according to claim 1, wherein the 1,3-dialkylbenzimidazolium halide (IV) is a compound selected from the group consisting of 1,3-dimethylbenzimidazolium bromide, 1,3-dimethylbenzimidazolium iodide, 1-methyl-3-ethylbenzimidazolium bromide, 1-methyl3-ethylbenzimidazolium chloride, 1-methyl-3-butylbenzimidazolium fluoride and 1-ethyl-3-propyl-benzimidazolium bromide.

10. An aluminum electroplating method according to claim 1, wherein the alicyclic quaternary ammonium halide (V) is a compound selected from the group consisting of N,N-dimethylpyrrolidinium bromide, N-ethyl-N-methylpyrrolidinium chloride, N,N-dimethylpiperidinium bromide, N-ethyl-N-methylpiperidinium chloride and N,N-diethylpiperidinium bromide.

11. An aluminum electroplating method according to claim 1, wherein the tetraalkylammonium halide (VI) is a compound selected from the group consisting of methyltriethylammonium chloride, diethyldimethylamonium bromide, ethyltrimethylammonium bromide, hexyltrimethylammonium bromide and butyltripropylammonium chloride.

* * * * *